US005257785A

United States Patent [19]

Sugie

[11] Patent Number: 5,257,785

[45] Date of Patent: Nov. 2, 1993

[54] JIGSAW PUZZLE

[75] Inventor: Daiki Sugie, Tokyo, Japan

[73] Assignee: Epoch Co., Ltd., Tokyo, Japan

[21] Appl. No.: 906,216

[22] Filed: Jun. 25, 1992

[30] Foreign Application Priority Data

Jun. 27, 1991 [JP] Japan ..... 3-57638[U]
Dec. 28, 1991 [JP] Japan ..... 3-113248

[51] Int. Cl.[5] ..... A63F 9/10; G09F 13/20

[52] U.S. Cl. ..... 273/157 R; 273/DIG. 24; 40/542

[58] Field of Search ..... 273/157 R, DIG. 24, 273/157 A, 153 R; 434/406; 362/84; 40/542-544; 428/33, 203, 690

[56] References Cited

U.S. PATENT DOCUMENTS 2,125,780 8/1938 Goggin ..... 40/542
2,822,288 2/1958 Harvey, Jr. et al. ..... 428/690
3,291,668 12/1966 Goldstein ..... 428/690
3,517,937 6/1970 Glass et al. ..... 273/157 A
4,745,286 5/1988 Jones ..... 40/542
4,844,990 7/1989 White ..... 40/542
5,084,309 1/1992 Smith et al. ..... 428/29

FOREIGN PATENT DOCUMENTS 0432698 6/1991 European Pat. Off. ..... 273/157 A

*Primary Examiner*—V. Millin
*Assistant Examiner*—Steven B. Wong
*Attorney, Agent, or Firm*—Darby & Darby

[57] ABSTRACT

A jigsaw puzzle is disclosed comprising a plurality of interlocking puzzle pieces to complete a design on the surface of the puzzle pieces. Each of the plurality of interlocking puzzle pieces comprising a base member, a luminous sheet containing a luminous material provided on the base member, and a design layer having a portion of a design provided on the surface of the luminous sheet so that a design is formed on the surface of the plurality of puzzle pieces when each of the plurality of puzzle pieces is inlaid at a predetermined position.

10 Claims, 2 Drawing Sheets

JIGSAW PUZZLE

BACKGROUND OF THE INVENTION

1. Field of the Invention

The present invention relates to a jigsaw puzzle comprising a plurality of interlocking puzzle pieces to complete a design on the surface of the puzzle pieces as a pastime that has long been enjoyed by players, and in particular, relates to a jigsaw puzzle which enables the seeing of the design in the dark by emitted light from a luminous material.

2. Related Art

Conventionally, a jigsaw puzzle having a design which was visible in the dark was nearly produced by applying a luminous pigment or the like to draw a simple picture like a chart on a pattern which was printed on the surface of a jigsaw puzzle. In the conventional method, a fine line of the luminous pigment or the like is applied along the outlines of the design or along the outlines of other configurations to emit light from the applied lines in the dark.

However, in the conventional method, the work of application of the luminous pigment or the like to draw a picture like a chart was relatively troublesome. The luminous pigment or the like of the conventional jigsaw puzzle had a limited ability to store light, so that the light-emitting time according to the luminous pigment or the like was very short such as several tens of seconds. Furthermore, since light was emitted from only the applied portion of the luminous pigment or the like, it was difficult to see the design on the surface of the jigsaw puzzle.

SUMMARY OF THE INVENTION

The present invention was developed in view of the above circumstances.

An object of the present invention is to provide an improved jigsaw puzzle to enable the seeing of the design in the dark by emitted light from a luminous material, which has a simple structure and is suitable for production on a large scale to be produced at low cost.

Another object of the present invention is to provide an improved jigsaw puzzle which can have a large amount of stored light, so that the light-emitting time according to the luminous pigment or the like is long so as to enjoy the glistening jigsaw puzzle for a long time.

Further, another object of the present invention is to provide an improved jigsaw puzzle which can emit light through the entirety of the background of the design of the jigsaw puzzle from the backside thereof in the dark so as to show a three dimensional design by the background light; the design thereof is visible easily and beautifully.

The purpose of present invention is to attain the above objects.

The present invention comprises a jigsaw puzzle to give enjoyment by interlocking a plurality of puzzle pieces with one another to complete a design on the surface of the puzzle pieces, wherein each of the puzzle pieces is comprised of a base member, a luminous sheet containing a luminous material disposed on the base member, and a design layer having a piece of design disposed on the surface of the luminous sheet so that a design is formed on the surface of the plurality of puzzle pieces when each of the plurality of puzzle pieces is inlaid at the predetermined position.

In the jigsaw puzzle of the present invention, the luminous sheet containing a luminous material is provided on the surface of the base member of the puzzle pieces by adhesion or the like. A design layer is provided on the surface of the luminous sheet. Therefore, light is emitted from the backside of the design layer having a picture, a pattern or the like to produce the picture, pattern or the like of the design layer from the entirety of the background thereof, when the luminous material of the luminous sheet radiates light.

Preferably, in the jigsaw puzzle according to the present invention a reflective layer is disposed between the luminous material layer and surface of the base member.

In the jigsaw puzzle having such a structure, when the luminous material of the luminous sheet emits light, the light traveling toward the reflective layer is reflected toward the surface of the jigsaw puzzle by the reflective layer. Therefore, most of the light emitted from the luminous material is directed toward the surface of the jigsaw puzzle and is not wasted.

Preferably, the present invention comprises a jigsaw puzzle to give enjoyment by interlocking a plurality of puzzle pieces with one another to complete a design on the surface of the puzzle pieces, wherein each of the plurality of puzzle pieces comprising a base member, a luminous material layer which comprises a luminous material applied on the base member, and a design layer having a portion of a design provided on the surface of the luminous material layer by a printing means so that a design is formed on the surface of the plurality of puzzle pieces when each of the plurality of puzzle pieces is inlaid at the predetermined position.

In the jigsaw puzzle having such a structure, the luminous material of the luminous material layer receives light from the surface side thereof to store the light energy. When the surroundings become dark, the luminous material of the luminous material layer releases the stored energy as emitted light. Consequently, light is radiated from the backside of the design layer having a picture, a pattern or the like, to show the picture, pattern or the like of the design layer in three dimensions from the entirety of the background thereof

DETAILED DESCRIPTION OF THE PREFERRED EMBODIMENTS

The present invention will be explained in detail in conjunction with the drawings.

Figure 1:
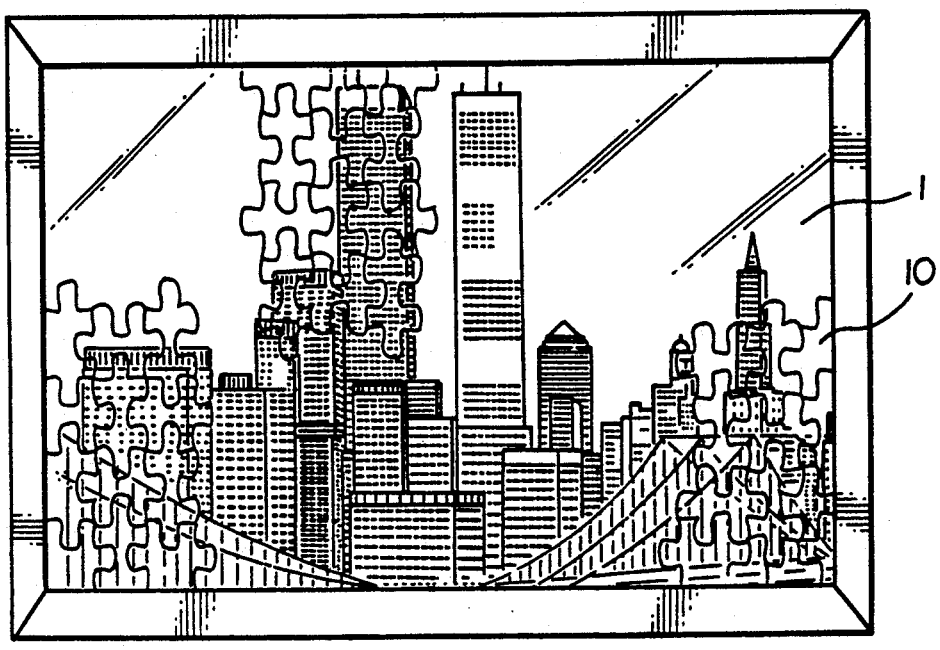
FIG. 1 is a front view showing a jigsaw puzzle according to the present invention.
Figure 2:
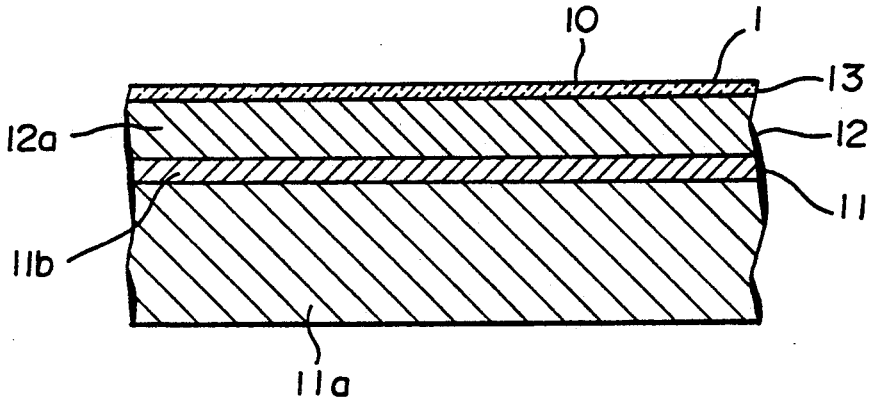
FIG. 2 is a partial sectional view showing a piece of the jigsaw puzzle according to the present invention.

A jigsaw puzzle 1 to give enjoyment by interlocking a plurality of puzzle pieces 10 with one another to complete a design on the surface of the puzzle pieces 10 is shown in FIGS. 1 and 2. Each of the puzzle pieces 10 comprises a base member 11, a luminous sheet 12 containing an appropriate luminous material **12*a* adhered on the surface of the base member 11, and a design layer 13 expressing a part of a design such as a part of picture, pattern or the like thereon provided on the surface of the luminous sheet 12. In the jigsaw puzzle 1 of the embodiment, a design such as a picture, a pattern or the like to show the picture, pattern or the like of the design layer 13 is easily visible for a long time (for example, about 30 minutes) even in the dark by light emitted from the luminous material 12***a* of the luminous sheet 12.

The base member 11 comprises a base piece 11*a* made of a thick paper or the like, and a reflector piece 11*b* made of a white paper adhered on the surface of the base piece 11*a*. The base member 11 is cut in a predetermined size and shape. It is possible to use other structures, materials or the like concretely for the base member.

The luminous sheet 12 comprises a mixture of a desired synthetic resin such as a vinyl chloride resin or the like, and a desired luminous material 12*a* such as luminous pigment or the like of relatively high blending ratio. The luminous sheet 12 is formed in the form of a thin sheet having a size and a shape similar to those of the base member 11. The concrete structure, material or the like of the luminous sheet 12 may be determined appropriately. That may be any structure, material or the like which can store some light energy and can radiate light for some time by the stored light energy.

The design layer 13 is formed by printing a design such as a picture, pattern or the like on the surface of the luminous sheet 12 or by adhering a very thin lighttransmissive synthetic resin sheet having a printed design on the surface of the luminous sheet 12. The concrete structure, material or the like of the design layer 13 may be determined appropriately.

Figure 3:
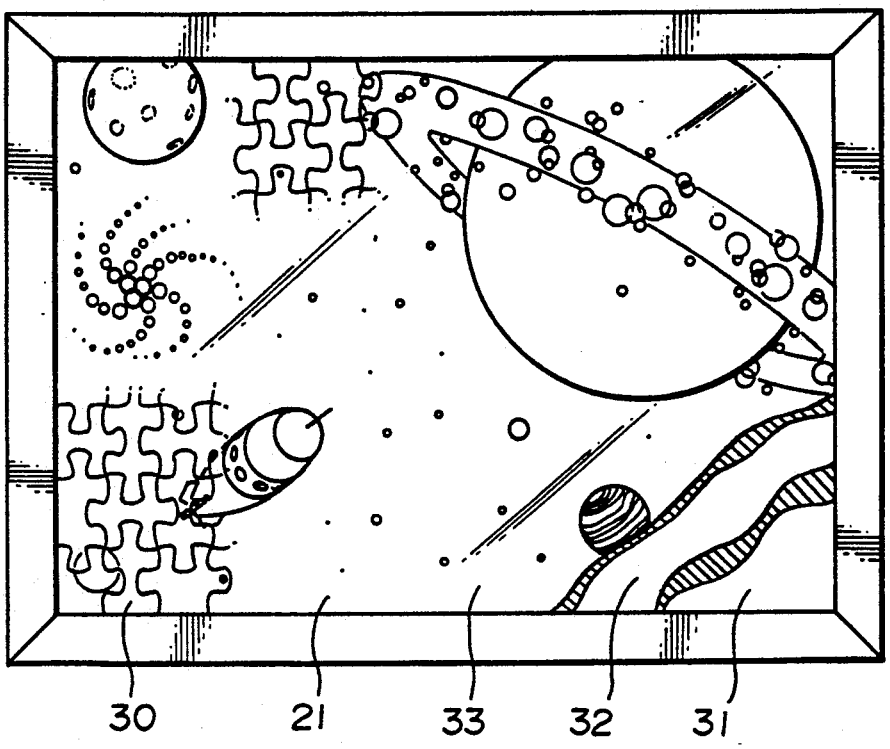
FIG. 3 is a partially fragmentary and front view showing a jigsaw puzzle.
Figure 4:
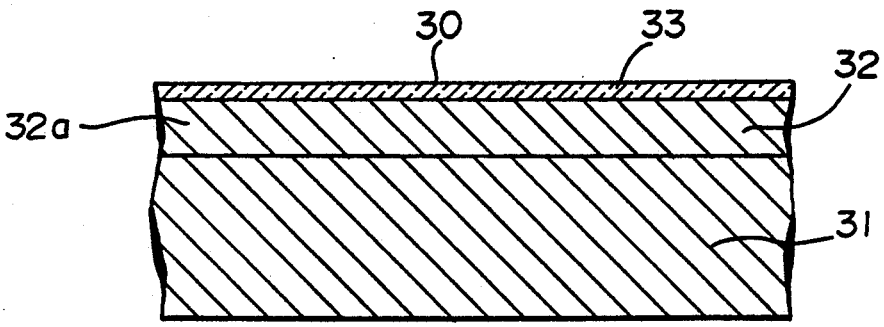
FIG. 4 is a partial sectional view showing a piece of jigsaw puzzle according to another embodiment of the present invention.

FIGS. 3 and 4 show another embodiment of the jigsaw puzzle of the present invention. In this embodiment, a jigsaw puzzle 21 comprises a plurality of puzzle pieces 30 which can be fitted with one another to complete a design thereon. Each of the puzzle pieces 30 comprises a base member 31, a luminous material layer 32 comprising an applied layer with a desired luminous material 32*a* on the entire surface of the base member 31, and a design layer 33 expressing a part of design such as a part of picture, pattern or the like on the surface of the luminous material layer 32 by a proper printing process. In the jigsaw puzzle 21 of the embodiment, a design such as a picture, a pattern or the like to show the picture, pattern or the like of the design layer 33 is easily visible for a long time (for example, about 30 minutes) even in the dark by light emitted from the luminous material 32*a* of the luminous material layer 32.

The base member 31 comprises a desired thick paper or the like. The base member 31 is cut in a predetermined size and shape. It is possible to provide a reflective layer having an excellent reflective characteristic such as a white paper or the like on the base member 31 to reflect the light from the luminous material layer 32 toward the surface side of the jigsaw puzzle 21.

The luminous material layer 32 comprises a desired luminous material such as a luminous pigment or the like which is applied on the entire surface of the base member 31. The concrete structure, material or the like of the luminous material layer 32 may be determined appropriately. That may be any structure, material or the like which can store some light energy and can radiate light for some time by the stored light energy.

A method of using the jigsaw puzzle 1 and 21 will be described as follows.

First, light energy is sufficiently stored by the luminous material 12*a* of the luminous sheet 12 or by the luminous material 32*a* of the luminous material layer 32. When the surroundings become dark, the luminous material 12*a* or 32*a* releases the stored light energy. Consequently, light is radiated from the backside of the design layer having a picture, a pattern or the like, to show the picture, pattern or the like of the design layer in three dimensional from the entirety of the background thereof.

Therefore, according to the present invention, it is possible to provide an improved jigsaw puzzle lighting in the dark by emitted light from a luminous material, which has a simple structure and is suitable for production on a large scale and at low cost. Furthermore, the present invention provides an improved jigsaw puzzle which can have a large amount of stored light, so that the light-emitting time according to the luminous pigment or the like is long so as to allow the enjoyment of the glistening jigsaw puzzle for a long time.

The present invention provides an improved jigsaw puzzle which can emit light through the entirety of the background of the design of the jigsaw puzzle from the backside thereof in the dark to show a raised design by the background light, so that the design thereof is easily visible in detail. It is therefore possible to obtain a beautiful and interesting jigsaw puzzle.

According to the jigsaw puzzle having a reflective layer on the surface of the base member, when the luminous material of the luminous sheet emits light, the light directed toward the reflective layer is reflected toward the surface of the jigsaw puzzle by the reflective layer Therefore, most of the light emitted from the luminous material can be directed toward the surface of the jigsaw puzzle and is not wasted. It is therefore possible to more strongly illuminate the picture, pattern or the like of the design layer from the backside thereof in the dark.

According to the jigsaw puzzle having a luminous material layer which comprises a luminous material applied on the base member, when the surroundings become dark, the luminous material of the luminous material layer releases the stored light energy, so that light can be radiated from the backside of the design layer having a picture, a pattern or the like, to show the picture, pattern or the like of the design layer from the entirety of the background thereof. It is possible to provide an improved jigsaw puzzle lighting in the dark by emitted light from a luminous material, which has a simple structure and is suitable for production on a large scale at low cost.

Furthermore, since the luminous material layer is applied on the entire surface of the base member of the jigsaw puzzle, the improved jigsaw puzzle of the present invention can store a large amount of light, so that the light-emitting duration according to the luminous pigment or the like is long so as to enable the enjoyment of the glistened jigsaw puzzle for a long time. Consequently, light can be radiated from the backside of the design layer having a picture, a pattern or the like, to show the picture, pattern or the like of the design layer from the entirety of the background thereof in three dimensions, like a back light.

What is claimed is:

1. A jigsaw puzzle comprising a plurality of puzzle pieces to complete a predetermined design by interlocking the plurality of puzzle pieces each of which has a design element thereon, wherein each of said plurality of puzzle pieces comprises:

a base member having a reflective layer on substantially the whole surface thereof, a luminous sheet containing a luminous material disposed on substantially one whole surface of said reflective layer of the base member, wherein the luminous sheet containing the luminous material can store light energy and radiate light for more than several tens of seconds, and a design layer having a piece of design disposed on the surface of said luminous sheet so that the predetermined design si formed on the surface of the plurality of puzzle pieces when each of the plurality of puzzle pieces is interlocked at the predetermined position, and thereby the predetermined design can be displayed by emitting light through the entirety of the background of the predetermined design for more than several tens of seconds when the surroundings become dark.

2. A jigsaw puzzle as claimed in claim 1, wherein said luminous sheet is adhered on said base member.

3. A jigsaw puzzle as claimed in claim 1 wherein the reflective layer comprises a white paper.

4. A jigsaw puzzle comprising a plurality of puzzle pieces to complete a predetermined design by interlocking the plurality of puzzle pieces each of which has a design element thereon, wherein each of said plurality of puzzle pieces comprises:

a base member, a luminous material layer which comprises a luminous material applied on substantially the whole surface of said base member, wherein the luminous material layer comprising the luminous material can store light energy and radiate light for more than several tens of seconds, and a design layer having a piece of design disposed on the surface of said luminous material layer by a printing means so that the predetermined design is formed on the surface of the plurality of puzzle pieces when each of the plurality of puzzle pieces is interlocked at the predetermined position, and thereby the predetermined design can be displayed by emitting light through the entirety of the background of the predetermined design for more than several tens of seconds when the surroundings become dark.

5. A jigsaw puzzle as claimed in claim 4, wherein a reflective layer is disposed on the surface of said base member.

6. A jigsaw puzzle as claimed in claim 5, wherein the reflective layer comprises a white paper.

7. A jigsaw puzzle as claimed in claim 4, wherein the luminous material layer comprising the luminous material can store light energy and radiate light for at least 30 minutes.

8. A jigsaw puzzle comprising a plurality of puzzle pieces to complete a predetermined design by interlocking the plurality of puzzle pieces each of which has a design element thereon, wherein each of said plurality of puzzle pieces comprises:

a base member having a reflective layer on substantially whole surface thereof, a luminous sheet containing a luminous material provided on substantially whole surface of said reflective layer of the base member, wherein the luminous sheet containing the luminous material can store light energy and radiate light for at least 30 minutes, and a design layer having a piece of design disposed on the surface os said luminous sheet so that the predetermined design is formed on the surface of the plurality of puzzle pieces when each of the plurality of puzzle pieces is inlaid at the predetermined position, and thereby the predetermined design can be displayed by emitting light through the entirety of the background of the predetermined design for at least 30 minute when the surroundings become dark.

9. A jigsaw puzzle as claimed in claim 8, wherein said luminous sheet is adhered on said base member.

10. A jigsaw puzzle as claimed in claim 8, wherein the reflective layer comprises a white paper.

* * * * *